US006840533B2

(12) United States Patent
Gignoux et al.

(10) Patent No.: US 6,840,533 B2
(45) Date of Patent: Jan. 11, 2005

(54) BOOT/BINDING ASSEMBLY FOR A SNOWBOARD

(75) Inventors: Pierre Gignoux, Coublevie (FR); Alain Plassiard, La Murette (FR)

(73) Assignee: Emery S.A., Saint Egreve (FR)

( * ) Notice: Subject to any disclaimer, the term of this patent is extended or adjusted under 35 U.S.C. 154(b) by 0 days.

(21) Appl. No.: 10/287,426

(22) Filed: Nov. 4, 2002

(65) Prior Publication Data

US 2003/0090088 A1 May 15, 2003

(30) Foreign Application Priority Data

Nov. 5, 2001 (FR) ..... 01 14257

(51) Int. Cl.[7] ..... A63C 9/16; A63C 9/20

(52) U.S. Cl. ..... 280/624; 280/607; 280/613; 280/624; 280/14.21

(58) Field of Search ..... 280/611, 613, 280/623, 624, 14.21, 14.22, 617, 618, 607

(56) References Cited

U.S. PATENT DOCUMENTS 5,938,228 A * 8/1999 Bourdeau ..... 280/607
5,957,479 A 9/1999 Bayer et al.
6,065,767 A * 5/2000 Girotto et al. ..... 280/607
6,113,127 A 9/2000 Karol
6,126,179 A 10/2000 Dodge
6,227,552 B1 5/2001 Keller et al.
6,276,708 B1 8/2001 Hogstedt
6,279,924 B1 * 8/2001 Murphy et al. ..... 280/14.23
2002/0000708 A1 1/2002 Emery

FOREIGN PATENT DOCUMENTS

EP 0 931 570 A 7/1999
FR 2 808 699 A 11/2001

* cited by examiner

*Primary Examiner*—Christopher P. Ellis
*Assistant Examiner*—Brian Swenson
(74) *Attorney, Agent, or Firm*—Bugnion S.A.; John Moetteli

(57) ABSTRACT

The boot/binding assembly for a snowboard with an automatic binding has a base (12) having a device (14) for holding the boot via its sides and complementary forms guiding and positioning the boot in the binding. The guiding and positioning forms (16) located on the binding extend above the holding device (14) for holding the boot so as to prevent the actuation of the holding device until the boot is fully positioned relative to the binding.

8 Claims, 1 Drawing Sheet

BOOT/BINDING ASSEMBLY FOR A SNOWBOARD

BACKGROUND OF THE INVENTION

The subject of the invention is a boot/binding assembly for a snowboard with automatic binding comprising a base carrying at least one means for holding the boot via at least one of the sides, shaped so as to engage with the holding means, and in which the binding and the boot have complementary guiding and positioning means for ensuring the correct positioning of the boot relative to the means for holding the binding, the upper end of the guiding means located on the binding being located above the means for holding the boot.

PRIOR ART

Boot/binding assemblies of this type are known from patents U.S. Pat. No. 5,957,479, the content of which is incorporated by reference, U.S. Pat. No. 6,113,127, the content of which is incorporated by reference, U.S. Pat. No. 6,126,179, the content of which is incorporated by reference and U.S. Pat. No. 6,227,552, the content of which is incorporated by reference.

In the boot/binding assembly according to U.S. Pat. No. 5,957,479, the boot is equipped, for its binding, with lateral projections extending longitudinally on each side of the boot, these projections engaging under pivoting jaws of the binding. The front and rear ends of the projections are chamfered in vertical planes. On each side of each of the jaws, the binding has guiding pieces equipped with faces that are inclined in their upper part, the lateral projections of the boot sliding over these inclined surfaces and engaging between the guiding pieces for the longitudinal positioning of the boot. Transverse positioning is practically absent, and as the longitudinal positioning takes place only when the lateral projections of the boot are below the holding jaws of the binding, the projections of the boot risk abutting on these jaws instead of bearing on the entrainment parts of these jaws.

In the boot/binding assembly according to U.S. Pat. No. 6,113,127, the boot also has, in order to be held in the binding, longitudinally extending lateral projections of which the ends are chamfered. On each side, the binding has inclined surfaces for the lateral guiding of the boot, over which inclined surfaces the lateral projections of the boot slide in order to engage in housings in the binding. Longitudinal positioning is provided by inclined surfaces at each end of these housings. Although guiding for transverse positioning is relatively early, the same does not apply to the axial or longitudinal positioning, which does not take place until the last moment, upon arrival in the locking position. This longitudinal positioning is very brief and requires the positioning error to be corrected by guiding to be small, otherwise the projections on the boot cannot engage in their housing.

In the boot/binding assembly according to U.S. Pat. No. 6,126,179, the guiding is provided by a recess located in the region of one of the lateral recesses of the boot in which the jaws of the binding engage. In this case, also, guiding is late and does not allow more than a slight error in position upon engagement of the boot in the binding.

In the boot/binding assembly according to EP 0 931 570, guiding and holding of the boot are provided by a ring integral with the boot sole and interacting with the jaws of the binding. In this case, guiding is late and does not allow more than a slight error in position upon engagement of the boot in the binding.

SUMMARY OF THE INVENTION

The object of the present invention is essentially to ensure that positioning of the boot is achieved before the boot reaches the region of the holding means located on the binding, such that an unexpected action on a piece of the binding that should not be entrained by the boot is excluded.

To this end, the boot/binding assembly according to the invention is defined in that the guiding and positioning means located on the binding extend perpendicular to the base, and in that the guiding and positioning means located on the boot are distinct from the shapings for engaging with the holding means.

The upper end of the vertical parts of the guiding and positioning means on the binding is located, preferably, more than 10 mm above the means for holding the boot.

The guiding and positioning means located on the binding and the complementary means located on the boot advantageously consist of complementary male and female profiles.

Preferably, the guiding profiles on the binding are male profiles and the profiles on the boot are female profiles.

According to one embodiment, the upper part of the guiding profiles on the binding has a ramp for lateral centering of the boot relative to the binding. The upper part of the guiding profiles on the binding advantageously has ramps for longitudinal centering of the boot relative to the binding.

The guiding profiles on the boot advantageously have at least one ramp for longitudinal centering of the boot relative to the binding.

In a binding equipped with a pair of jaws mounted so as to pivot about a horizontal axis and respectively integral with an entrainment arm to be entrained by the boot, the guiding profiles may be located to the front or to the rear of the jaws.

BRIEF DESCRIPTION OF THE DRAWINGS

The appended drawing shows, by way of example, one embodiment of the invention.

DESCRIPTION OF THE PREFERRED EMBODIMENT

Figure 1:
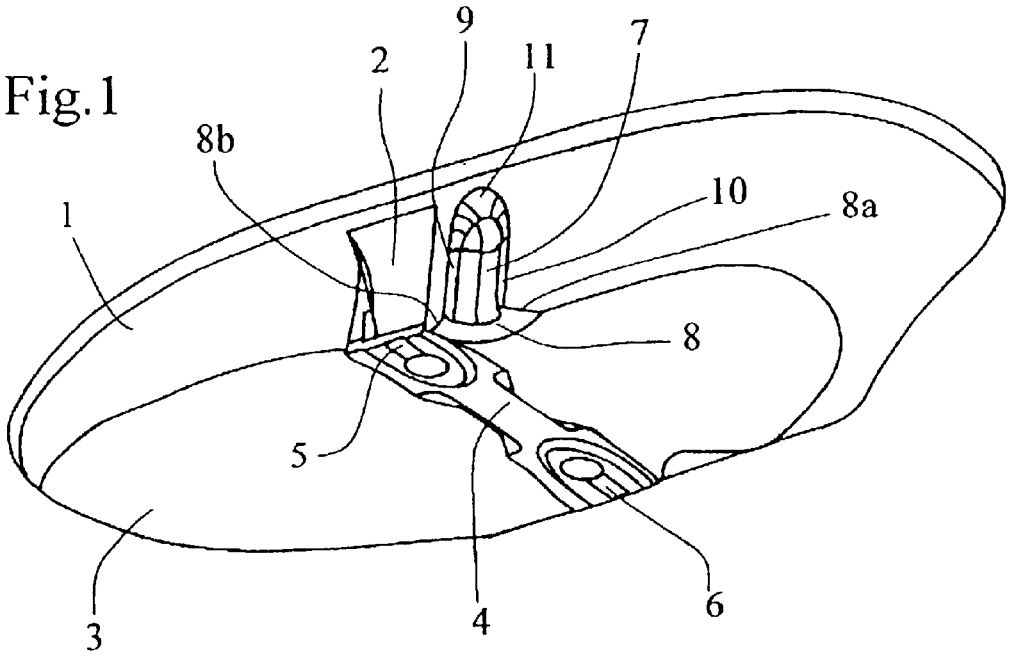
FIG. 1 is a perspective view from below of a boot sole.

FIG. 1 shows the lower part 1 of a snowboarding boot. This part 1 is made from relatively rigid plastic. On each side, it has a recess 2, the depth of which increases progressively from top to bottom. A metal plate 4, the ends 5 and 6 of which are flush with the edge of the sole 3 at the bottom of the recesses 2, is fixed under the boot, embedded transversely in the sole 3. On each side of the boot, the lower part 1 of the boot also has two female guiding profiles formed by two recesses 7 and located to the rear of the recesses 2, and the central part of which has a prismatic cross section with an axis perpendicular to the plane of the sole 3. The edges of the profiles 7 are also chamfered so as to have a chamfer 8 in the edge of the sole, two lateral chamfers 9 and 10, and an upper chamfer 11 of rounded shape forming the join between the lateral chamfers 9 and 10. The chamfer 8 helps to center the boot in the longitudinal direction relative to the binding via its inclined ends 8*a* and 8*b*, as will be described below.

Figure 2:
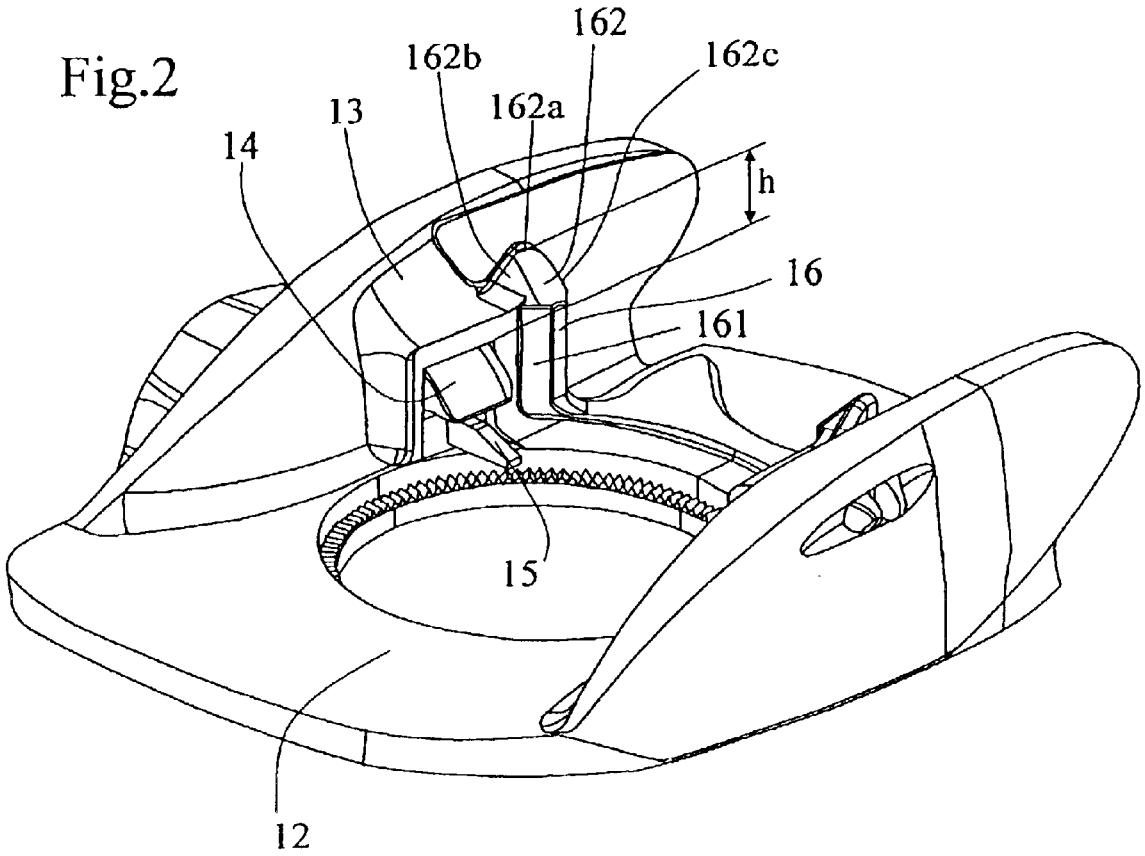
FIG. 2 is a perspective view of the binding for receiving the boot sole shown in FIG. 1.

The binding shown in FIG. 2 is of the type described in the U.S. patent application Ser. No. 09/844,021, incorporated by reference. For a detailed description, reference will therefore be made to that document. This binding includes a base 12 supporting two identical and opposite binding elements for holding the boot. As the binding elements are identical, only the element that can be seen in FIG. 2 will be described.

The binding element comprises a structure 13 that is made, in this case, in a single piece with the base 12. A jaw 14 that is able to pivot about a horizontal axis against the action of a spring tending to hold the jaw 14 in the open position is mounted in the structure 13. The jaw is equipped with a pedal 15 for its entrainment by the boot, more precisely by the ends 5 and 6 of the plate 4 of the boot, when the boot is placed in the binding. The jaws 14 then engage in the recesses 2 of the boot and bear on the ends of the plate 4.

A male guiding profile 16 rises beside each of the structures 13 and is formed by a projection consisting of a first part 161 of prismatic shape with an axis perpendicular to the base 12, and a second part 162 surmounting the part 161 and having a first inclined face 162*a* inclined toward the central zone of the binding, i.e. toward the inside, for the lateral centering of the boot relative to the binding, a second inclined face 162*b* inclined toward the front of the binding, and a third inclined face 162*c* inclined toward the rear of the binding. The prismatic part 161 extends as far as the upper edge of the structure 13, i.e. substantially above the jaw 14, and the upper end of the guiding profiles 16 is located at a height h greater than 10 mm above the jaws 14, with the jaws in the open, raised position.

When the boot is fitted into the binding, the boot abuts on the part 162 of the projections 16 and, if necessary, the boot is displaced longitudinally until the chamfers 8 of the boot abut on the parts 162, more precisely when one of the ends 8*a* or 8*b* of the chamfer 8 abuts on the face 162*c* or 162*b*, respectively. By sliding over the faces 162*a*, 162*b*, and 162*c*, the boot is guided toward the prismatic parts 161 that then engage in the prismatic recesses 7 of the boot. This engagement is facilitated by the chamfers 9 and 10. Before reaching the region of the jaws 14, the boot is fully positioned relative to the binding. The boot continues its descent, perfectly guided, as if on rails, by the prismatic parts 161, and the fitting of the boot into the binding is achieved precisely and smoothly.

The guiding according to the invention is also applicable to a binding that includes a single movable jaw on one side. The cross section of the prismatic part 161 may be of any shape. It may have rounded angles. The projections could be in the form of segments of a cylinder with a circular or noncircular cross section. The upper part 162 could also be of a different shape.

In a complementary manner, the guiding means could be very different from those shown by way of example. However, it is advantageous for the guiding means to be totally distinct from the holding means, i.e. located beside the holding means both on the binding and on the boot. Unlike that which has been shown, the boot could have male parts that engage and slide in female parts of the binding.

To provide positioning of the boot relative to the binding, it suffices to have, on the binding or the boot, ramps such as the ramps 162 for lateral centering of the boot, and opposite slopes for providing longitudinal centering of the boot. These slopes may be solely on the binding or on the boot. In particular, the slopes formed by the chamfer 8 may by themselves provide this longitudinal positioning.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A boot/binding assembly for a snowboard with automatic binding comprising a base (12) carrying at least one means (14) for holding the boot via at least one of the sides (2, 4) formed so as to engage with the holding means, and in which the binding and the boot have complementary guiding and positioning means for ensuring the correct positioning of the boot relative to the means for holding the binding, the upper end of the guiding means located on the binding being located above the means for holding the boot, wherein a vertically oriented structure (16) located on the binding extends perpendicular to the base (12) and mates with a corresponding vertically oriented structure in the boot so as to constrain the binding and boot against excessive front to back motion during insertion and wherein the corresponding vertically oriented structure located on the boot (7) are distinct from the sides (2, 4) for engaging with the holding means.

2. The boot/binding assembly as claimed in claim 1, wherein the upper end of the vertically oriented structure (16) on the binding is located more than 10 mm above the means for holding the boot.

3. The boot/binding assembly as claimed in claim 1, wherein the vertical structure (16) located on the binding the corresponding structure (7) located on the boot comprise corresponding male and female profiles.

4. The boot/binding assembly as claimed in claim 3, wherein the vertical structure (16) on the binding is a male structures and the complementary guiding structure (7) of the boot is a female structure.

5. The boot/binding assembly as claimed in claim 4, wherein the upper part of the vertical structure (16) on the binding has a ramp (162*a*) for lateral centering of the boot relative to the binding.

6. The boot/binding assembly as claimed in claim 5, wherein the upper part of the vertical structure (16) on the binding has a ramp (162*b*, 162*c*) for longitudinal centering of the boot relative to the binding.

7. The boot/binding assembly as claimed in claim 6, wherein the complementary guiding structure (7) on the boot has at least one ramp (8) for longitudinal centering of the boot relative to the binding.

8. The boot/binding assembly as claimed in claim 1, in which the holding means comprises a pair of jaws (14) each mounted so as to pivot about a horizontal axis and respectively integral with a pedal (15) for entrainment of the boot relative to the binding during insertion of the boot into the binding, wherein the guiding and positioning means (16) on the binding are located beside the jaws to the front or to the rear of these jaws.

* * * * *